US005133551A

United States Patent [19]

Handy et al.

[11] Patent Number: 5,133,551

[45] Date of Patent: Jul. 28, 1992

[54] SOUND PRODUCING GAME BAT

[75] Inventors: John N. Handy, Long Beach; Ake L. Larsson, Palos Verdes Estates, both of Calif.

[73] Assignee: Mattel, Inc., El Segundo, Calif.

[21] Appl. No.: 825,213

[22] Filed: Jan. 24, 1992

Related U.S. Application Data

[63] Continuation-in-part of Ser. No. 745,561, Aug. 15, 1991.

[51] Int. Cl.[5] ..... A63B 59/06

[52] U.S. Cl. ..... 273/72 R; 273/26 B

[58] Field of Search ..... 273/26 B, 26 R, 29 A, 273/183 D, 186 R, 186 A, 194 B, 72 R; 446/411, 421, 397

[56] References Cited

U.S. PATENT DOCUMENTS

| | | | |
|---|---|---|---|
| 514,420 | 2/1894 | Jacobus . | |
| 3,113,782 | 12/1963 | Guier | 273/26 B |
| 3,136,546 | 6/1964 | Conolly | 273/26 B |
| 3,137,504 | 6/1964 | Zordan et al. | 273/186 A |
| 3,173,688 | 3/1965 | Green | 273/72 R |
| 3,215,437 | 11/1965 | Webb | 273/186 A |
| 3,498,616 | 3/1970 | Hurst | 273/186 A |
| 3,572,706 | 3/1971 | Schroder | 273/26 B |
| 3,578,801 | 5/1971 | Piazza . | |
| 4,634,121 | 1/1987 | Sasaki | 273/26 B |
| 4,671,508 | 6/1987 | Tetrault | 273/26 B |
| 4,967,596 | 11/1990 | Rilling et al. | 273/186 A |
| 4,969,921 | 11/1990 | Silvera | 273/186 A |

*Primary Examiner*—Theatrice Brown

*Attorney, Agent, or Firm*—Roy A. Ekstrand

[57] ABSTRACT

A sound producing game bat includes a generally cylindrical slide tube having a center bore defined therein and a fluted outer surface. A generally cylindrical slide weight is received within the center bore of the slide tube and is captivated at the handle end by a resilient dampening plug. The hitting end of the game bat includes a sound producing unit having a sound unit housing within which a diaphragm and diaphragm cone are resiliently supported. During swings of the game bat by the batter, the slide weight travels through the center bore of the slide tube and strikes the diaphragm cone causing the diaphragm to vibrate and producing sound effects. A foam covering is molded upon the game bat to enclose virtually the entire bat in a secure attachment.

6 Claims, 3 Drawing Sheets

110
111
104
109
106
105
121
120
123
122
131
132
130
133
141
140
124
125
143
144
145
146
147
103

SOUND PRODUCING GAME BAT

CROSS-REFERENCE TO RELATED APPLICATION

This application is a continuation-in-part of copending application Ser. No. 07/745,561 filed Aug. 15, 1991 in the name of John N. Handy and entitled SOUND PRODUCING GAME BAT which is assigned to the assignee of the present application.

FIELD OF THE INVENTION

This invention relates generally to game bats and particularly to those having swing activated sounding devices.

BACKGROUND OF THE INVENTION

A number of games and sports are played using a bat, racket, club or similar instrument. For example, the popular game of golf is played with a collection of golf clubs each of which generally includes an elongated club shaft supporting a club striking head and a handle grip at opposite ends. Considerable variation of design and structure is found in golf clubs to meet the needs of different sized players and players of different strengths. In addition, golf clubs are varied to meet different types of play situations. Other games or sports are played using devices generally referred to as rackets such as tennis, racquetball or the like. The rackets in such games differs substantially from most other instruments and generally comprise an elongated handle having a generally oval frame within which a resilient material is strung in a screen-like structure.

While golf clubs and game rackets such as tennis or racquetball are commonly known and widely used game instruments, the most pervasive game instrument or club is most likely the pervasive baseball bat. The popularity of baseball has spread to a great number of nations about the world and the baseball bats used therein have generally tended to conform to the standards adopted in the United States of America. The standards have been subject to some variation. However, in general, baseball bats usually comprise an elongated circular cross section bat having a handle portion and gripping knob at one end and a thicker and heavier striking end at the opposite end. In most baseball bats, a general taper is provided between the handle portion and the striking end. By far the most common material used in making baseball bats is natural hardwood such as oak or the like. However, certain other materials such as aluminum or fiberglass have been adopted in other highly specialized league standards. In any event, baseball bats used in league play are subject to extremely rigid and confining league standards as to length, weight, size and configuration tolerances.

In addition to standard baseball bats accepted for standardized league play, a variety of nonstandard baseball bats have also been developed. One common type of baseball bat involves practice bats which are used primarily to develop strength or practice and perfect the swinging technique of the hitter. Such structures have included bats having unusual weight distribution as well as bats having removable or movable weights supported therein or thereon. Another type of nonstandard bat which has found substantial popularity may be generally described as amusement type baseball bats. Such amusement bats have included sounding mechanisms which produce audible sounds during the swinging or hitting action as well as bats having associated actions such as lights or movement.

U.S. Pat. No. 514,420 issued to Jacobus sets forth a BASEBALL BAT in which an impact force multiplying device is provided. The impact devices includes an elongated hollow passage defined within the striking end of the bat within which a plurality of weighted spherical balls are freely movable. A closure plug is threadably received at the striking end of the bat closing the passage and captivating the weighted balls within the passage. In an alternate embodiment, an elongated cylindrical sliding weight replaces the spherical balls. The intended function is provided by the change of bat characteristic during swinging as centrifugal force drives the weighted members outwardly from the passage end remote from the striking end to the striking end of the bat.

U.S. Pat. No. 3,173,688 issued to Green sets forth a GAME BAT WITH SWING-RESPONSIVE SOUNDING MEANS in which an elongated bat defines a typical external appearance similar to conventional baseball bats having a handle end and a striking end. The striking end is separate from the remainder of the bat and slidably movable with respect thereto. An elongated spring is coupled within the bat between the movable sliding striking end and the handle end of the bat to urge the striking end toward the handle. During swinging, centrifugal force thrusts the striking end outwardly overcoming the spring force. At the termination of swing, the spring overcomes the centrifugal force drawing the striking end back to the bat and producing a loud sound.

U.S. Pat. No. 3,578,801 issued to Piazza sets forth a PRACTICE BASEBALL BAT having an elongated hollow bat for baseball practice within which an elongated longitudinal rod is supported. A chamber extends along a portion of the elongated rod and supports a slidable weight thereon. During the swinging of the bat, the centrifugal force drives the weight outwardly toward the striking end of the bat.

U.S Pat. No. 3,137,504 issued to Zordan, et al. sets forth a PRACTICE SWING BAT having an elongated cylindrical chamber defined therein. An elongated cylindrical bore extends inwardly from the striking end of the bat and a movable weight is supported within the bore. The weight is received within a weight retaining mechanism which holds the weight at the center portion of the bat remote from the striking end until sufficient centrifugal force is plied to the bat dislodging the weight and thrusting it outwardly toward the striking end.

U.S. Pat. No. 4,671,508 issued to Tetreault sets forth a PRACTICE BAT having a hollow elongated bat within which a movable weight travels between the handle end and the striking end. The handle is preferably formed of a resilient deformable material whereby the weight may be secured within the handle end portion of the bat by squeezing the handle. When the squeeze is released, the weight moves outwardly to strike the striking end of the bat.

U.S. Pat. No. 3,113,782 issued to Guier sets forth a SWINGABLE PRACTICE CLUB WITH MAGNETICALLY RETAINED SLIDABLE SOUNDING DEVICE in which an elongated club having a shaft and handle similar to a golf club includes an outer striking end practice device which replaces the conventional striking end of the golf club. The practice device includes an elongated cylindrical housing within which a weight is movable and within which means are provided for indicating the force applied to the club striking end due to the centrifugal force action upon the weight during the swing.

U.S. Pat. No. 3,136,546 issued to Connolly sets forth a SWINGABLE PRACTICE GAME IMPLEMENT WITH SLIDING WEIGHT having a shaft and handle similar to a conventional golf club. A practice element replaces the club head at the striking end and includes a cylindrical member having a central bore formed therein. A moveable weight is resiliently supported within the central bore and is acted upon by centrifugal force during swinging. In an alternate embodiment, a practice game bat similar to a baseball bat is shown having the same weight supporting structure.

U.S. Pat. No. 4,588,387 issued to Swenson sets forth an ILLUMINATED INFANT TOY having an elongated generally cylindrical noise making device within which a plurality of lights are supported. Means are provided for sequentially illuminating the lights as a movable disk within the device interior travels back and forth within an elongated passage therein.

While the foregoing prior art devices have greatly expanded the available practice and amusement devices for baseball bats and similar articles, there remains a continuing need in the art for evermore improved practice and amusement devices such as game bats or the like.

SUMMARY OF THE INVENTION

Accordingly, it is a general object of the present invention to provide an improved sound producing game bat. It is a more particular object of the present invention to provide an improved sound producing game bat having a distinct sound characteristic which enhances the amusement and excitement of the sound producing game bat.

In accordance with the present invention, there is provided a game bat comprises: an elongated slide tube defining first and second ends and a passage therethrough; a slide weight slidably supported within the passage; a sound housing having an interior cavity coupled to the first end of the slide tube; a diaphragm supported within the sound housing; and a diaphragm cone; means for resiliently supporting the cone within the interior cavity proximate the diaphragm, the slide weight sliding through the passage during a batter swing to impact the diaphragm cone causing diaphragm vibration and sound.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
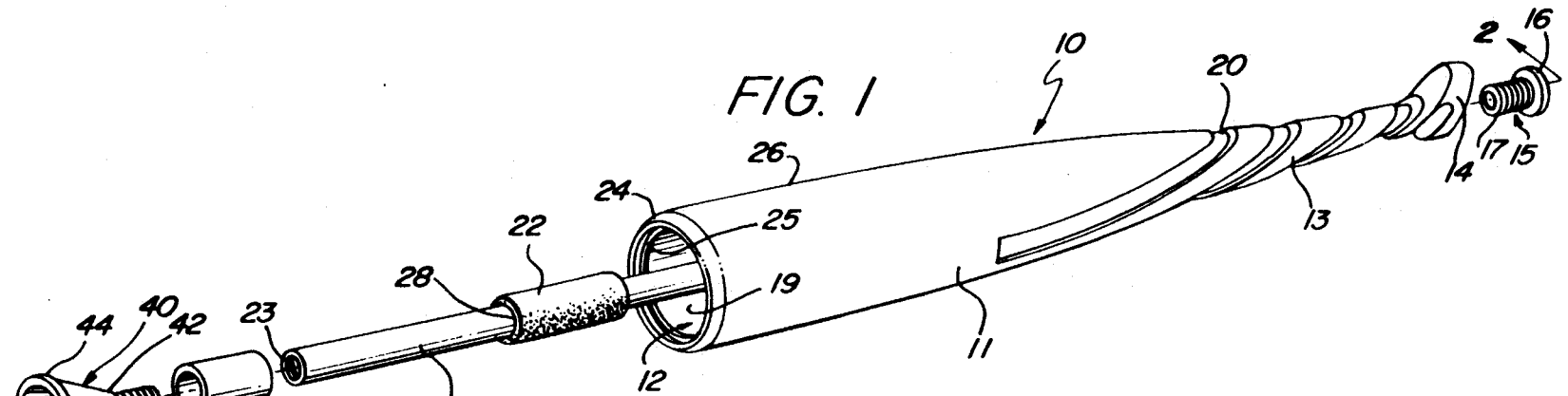
FIG. 1 sets forth a perspective assembly view of a game bat constructed in accordance with the present invention.

FIG. 1 sets forth a perspective assembly view of a sound producing game bat constructed in accordance with the present invention and generally referenced by numeral 10. Game bat 10 includes a generally hollow body preferably formed of a molded plastic material or the like which defines a handle portion 13, an expanded grip end 14 and a enlarged striking end 26. Striking end 26 defines a tapered end portion 24 and an aperture 19. In its preferred form, body 11 is hollow and thus defines an interior cavity 12. End 24 further defines a recess 25. A plurality of generally spiralled grooves 20 are formed in handle 13 to improve the gripping characteristics of game bat 10. As is better seen in FIG. 2, grip end 14 defines an aperture 60 extending therethrough and a surrounding recess 61.

Game bat 10 further includes an elongated generally cylindrical weight shaft 21 defining a bore 23 at one end and a bore 27 (at the remaining end). In the alternative, weight shaft 21 may be completely hollow in which case a center passage extends between bores 23 and 27. In either event, a generally cylindrical resilient damper 22 preferably formed of a foam plastic or foam rubber type material, defines a center passage 28 and is received upon weight shaft 21. In its preferred form, resilient damper 22 is tightly fitted to weight shaft 21 and thus, once placed thereon in accordance with the assembly set forth below in greater detail, tends to remain in a fixed position upon weight shaft 21. Game bat 10 further includes a generally cylindrical slide weight 30 defining a center passage 31. Slide weight 30 is preferably formed of a heavy material such as metal or the like and is loosely fitted upon weight shaft 21 and thus is slidable thereon. Thus, passage 31 is preferably sized sufficiently larger than the outer size of weight shaft 21 to permit easy sliding of slide weight 30.

In accordance with an important aspect of the present invention, game bat 10 further includes an acoustic sound cone 40 having a generally cone-shaped diaphragm portion 42 and a coupling element 43. Diaphragm 42 terminates in a generally annular rim 44. In further accordance with the present invention, diaphragm 42 defines a generally cone-shaped open chamber 41 extending inwardly from support rim 44. An end cap 15 includes a generally disk-shaped head portion 16 and a coupling element 17.

Game bat 10 is assembled in the manner shown in FIG. 1 by initially placing weight shaft 21 within interior cavity 12 of body 11. Thereafter, weight shaft 21 is moved inwardly toward handle 13 until the end thereof supporting bore 27 is received within aperture 60 of grip end 14 (the former better seen in FIG. 2). Cap 15 is then inserted into bore 27 such that coupling 17 is received in a tight secure insertion and such that head 16 is received within recess 61 of grip end 14.

With shaft 21 thus assembled within body 11, slide weight 30 is placed upon weight shaft 21 and finally sound cone 40 is aligned with weight shaft 21 such that coupling 43 is received within bore 33 of shaft 21. Thereafter, an inward or compressive force upon sound cone 40 drives coupling 43 into bore 23 to provide a secure attachment therebetween. It should be noted that the length of weight shaft 21 is carefully selected to permit rim 44 of sound cone 40 to be received within recess 25 of body 11 when the above-described assembly is completed.

It will be apparent to those skilled in the art that a variety of mechanical attachments may be utilized to secure couplings 43 and 17 within bores 23 and 27 respectively of weight shaft 21. For example, an adhesive material may be used to tightly bond the coupling members to weight shaft 21. Alternatively, a severe tight mechanical fit may be sufficient in some instances to provide secure attachment. It will be apparent, however, that other attachment forms such as thermal or sonic welding may be utilized as well as conventional threaded attachments.

Figure 2:
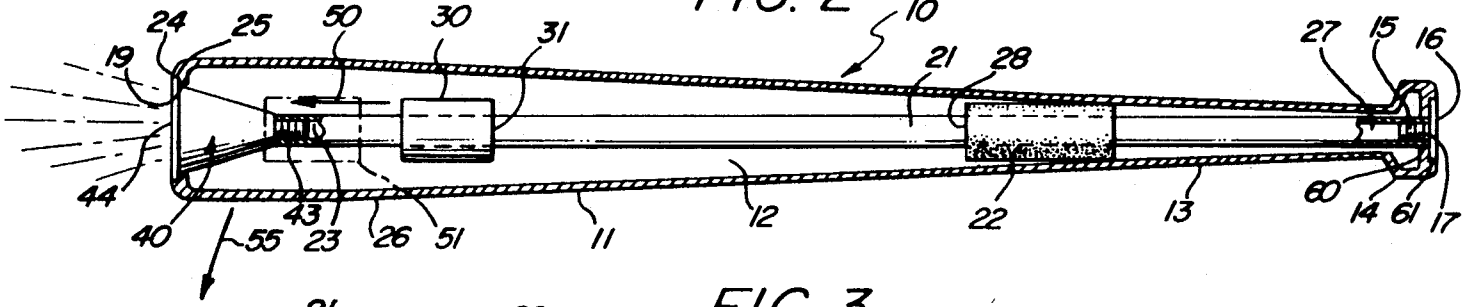
FIG. 2 sets forth a section view of the present invention game bat taken along section lines 2—2 in FIG. 1.

FIG. 2 sets forth a section view of game bat 10 taken along section lines 2—2 in FIG. 1. As described above, game bat 10 includes a hollow body 11 defining a striking end 26 having a tapered end portion 24 and an aperture 19 defined therein. End portion 24 further defines a recess 25 surrounding aperture 19. Body 11 also defines a handle portion 13 and an expanded grip end 14. The latter defines an aperture 60 and surrounding recess 61 therein.

An elongated generally cylindrical and preferably rigid weight shaft 21 defines an end bore 27 at one end and a bore 23 at the opposite end. Alternatively, weight shaft 21 may be fabricated as a hollow cylindrical member in which case bores 27 and 23 are inherently defined therein. Weight shaft 21 is supported within interior cavity 12 of hollow body 11 by cap 15 at one end and by sound cone 40 at the other end. Specifically, cap 15 includes a generally disk-shaped head 16 having a coupling element 17 extending therefrom. In the assembled position, head 16 is received within recess 61 while coupling element 17 is received within bore 27 of weight shaft 21. Similarly, sound cone 40 includes a generally cone-shaped diaphragm 42 defining an open chamber 41 and a coupling element 43. Coupling element 43 is received and secured within bore 23 of weight shaft 21. Cone 40 further defines a support rim 44 which is received within recess 25 of end portion 24. Thus, sound cone 40 is supported within recess 25 and extends inwardly through aperture 19 of end portion 24. As mentioned above, the attachment between cap 15 and sound cone 40 and weight shaft 21 may be accomplished using a variety of attachments such as an adhesive material or the like.

A generally cylindrical slide weight 30 defines an internal passage 31 and is slidably received upon weight shaft 21. A generally cylindrical resilient damper 21 defining an interior passage 28 is also received upon shaft 21. However, resilient damper 22 is preferably sized to fit snugly upon weight shaft 21. In the position shown in FIG. 2, damper 22 is spaced from grip end 14 of game bat 10. However, the position of resilient damper 22 upon weight shaft 21 may be selected in accordance with preference in that the position of resilient damper 22 upon shaft 21 defines the farthest point of travel for slide weight 30 in the direction of handle 13. Thus, the travel of slide weight 30 is maximized if resilient damper 22 is forced through a substantial portion of handle 13 toward grip end 14.

In operation, game bat 10 is initially raised to a somewhat vertical orientation causing the gravitational force upon slide weight 30 to draw slide weight 30 downwardly upon weight shaft 21 until it impacts resilient damper 22. Thereafter, the action of swinging game bat 10 in accordance with its general use in sports activities such as baseball causes striking end 26 to be moved in the direction indicated by arrow 55 as the user swings game bat 10 through an arced travel path. The centrifugal force operative upon slide weight 30 causes weight 30 to be accelerated upon weight shaft 21 in the direction indicated by arrow 50. As slide weight 30 impacts sound cone 40 in the position shown in dashed line representation 51, sound vibrations are produced in diaphragm 42 of sound cone 40 which reverberate outwardly through open chamber 41 producing audible sound energy. The character of sound produced may be controlled to some extent by the selection of materials used to fabricate diaphragm 42 and other physical characteristics of sound cone 40. In accordance with an important aspect of the present invention, the use of acoustic sound cone 40 in game bat 10 produces substantially increased sound output not realized by the prior art game bats having sound producing mechanisms. In addition, the character of sound produced by the impact of slide weight 30 is given a unique characteristic due to the cone shape of diaphragm 42 and sound cone 40.

At the completion of a swing by the user, game bat 10 may thereafter be again raised to a generally vertical orientation which again causes the gravitational force upon slide weight 30 to return slide weight 30 to resilient damper 22. In accordance with an additional important aspect of the present invention, the replacement of resilient damper 22 within body 11 of the present invention game bat avoids producing any appreciable sound or vibration or other impact responses as slide weight 30 returns to the area of handle 13. This has been found desirable in avoiding unnecessary and generally undesired sound and vibration by the user during successive "practice swings" or similar activities in which the bat is repeatedly swung back and forth by the user.

Figure 3:
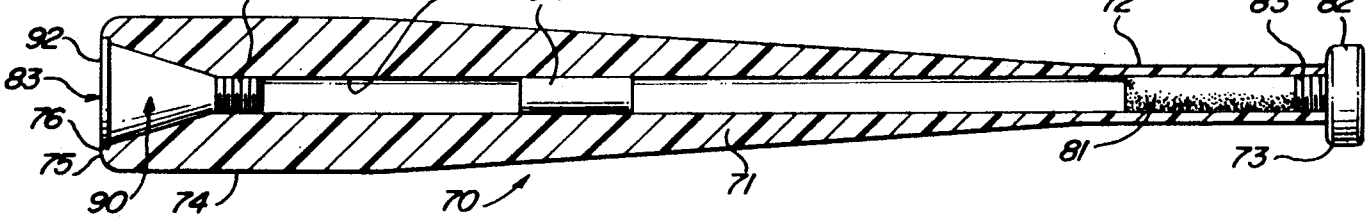
FIG. 3 sets forth a section view of an alternate embodiment of the present invention sound producing game bat.

FIG. 3 sets forth a section view of an alternate embodiment of the present invention game bat generally referenced by numeral 70. Game bat 70 includes a body 71 defining a center passage 80 therethrough. In contrast to game bat 10, game bat 70 is formed of a generally solid body 71 and thus is generally heavier than game bat 10. An end cap 73 defines a generally cylindrical head 82 and a coupling 83. The latter is received within center passage 80 of body 71 and is secured therein by a conventional attachment means such as adhesive bonding, thermal bonding or other attachment. A resilient damper 81 preferably formed of a foam plastic or rubber material is securely fitted within center passage 80 and is preferably pressed against coupling 83 of end cap 73. A generally cylindrical slide weight 94 is loosely fitted within central passage 80 and thus is slidably supported therein and free to move the length of passage 80.

In accordance with an important aspect of the present invention, game bat 70 further includes a sound cone 90 having a support rim 92 and defining an open chamber 93. Rim 92 is received within recess 76 of body 71. Sound cone 90 further includes a coupling element 91 which is received within center passage 80 in a secure attachment by means such as adhesive bonding or the like.

The operation of game bat 70 is substantially the same as that set forth above for game bat 10. Specifically, game bat 70 is initially raised to a generally vertical position causing the gravitational force upon slide weight 94 to draw it downwardly within center passage 80 until it impacts resilient damper 81. Thereafter, the rapid swinging motion of game bat 70 in an arced path produces a centrifugal force operative upon slide weight 94 to drive it outwardly through center passage 80 to impact coupling element 91 of sound cone 90. The impact thus produced reverberates through sound cone 90 causing a distinct audible sound to reverberate outwardly through open chamber 93 of sound cone 90. As with the embodiment set forth above, resilient damper 81 is operative to avoid undesired vibration or impact noises when slide weight 94 returns to the handle portion of game bat 70 as game bat 70 is raised to a vertical orientation.

Figure 4:
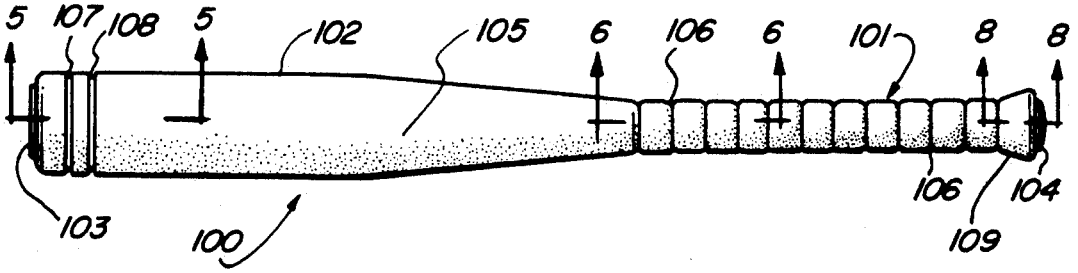
FIG. 4 sets forth a side view of an improved sound producing game bat constructed in accordance with the present invention.

FIG. 4 sets forth a side elevation view of an improved sound producing game bat constructed in accordance with the present invention and generally referenced by numeral 100. Game bat 100 includes a handle portion 101, an end knob 109 and a hitting end 102 formed in accordance with general proportions of a baseball game bat. Bat 100 further includes an extensive foam covering 105 which extends virtually the entire length of game bat 100 and which defines a pair of grooves 107 and 108 at the extreme end of hitting end 102 and a plurality of handle serrations 106 within handle portion 101. An end plug 104 is received within the interior of game bat 100 in the manner better seen in FIG. 8. A sound horn 103, the structure of which is better seen in FIG. 5, extends into hitting end 102 beneath foam covering 105. In accordance with the invention set forth below in greater detail, game bat 100 includes a solid interior frame having a slidable weight supported within the bat interior (seen in FIG. 5) and a resilient foam outer covering to produce a unique combination of bat characteristics. Among these interesting characteristics is the sound produced by the travel of the sliding weight within the interior of game bat 100 toward a sound unit (seen in FIG. 5) each time bat 100 is swung.

Figure 5:
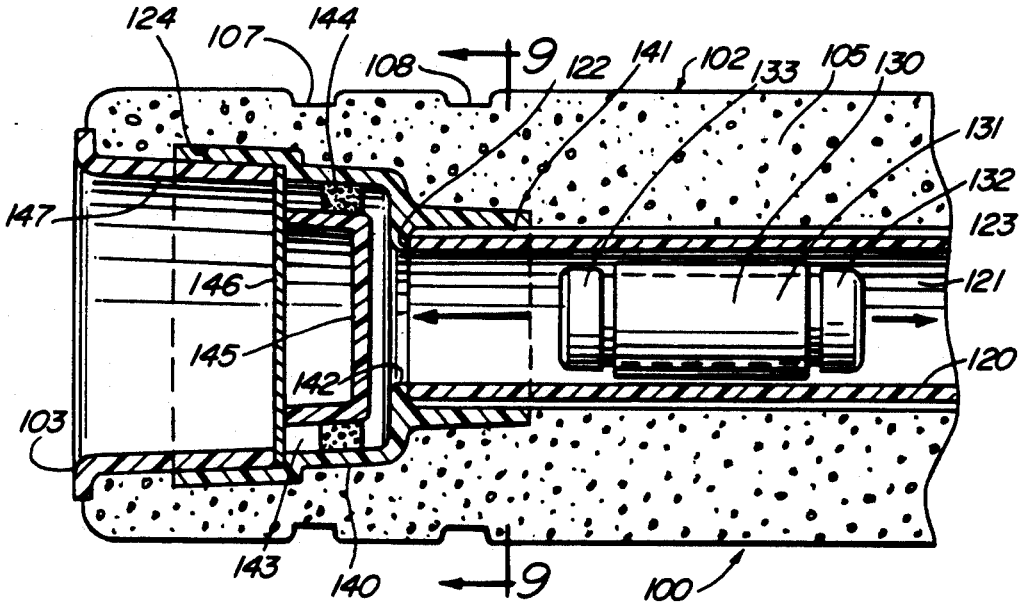
FIG. 5 sets forth a partial section view of a portion of the present invention game bat taken along section lines 5—5 in FIG. 4.

FIG. 5 sets forth a section view of game bat 100 taken along section lines 5—5 in FIG. 4. Game bat 100 includes a generally cylindrical slide tube 120 having an end portion 122, a center bore 121 and a fluted outer surface 123. A sound unit housing 140 defines an internally fluted bore 141 which receives fluted outer surface 123 of slide tube 120 in a secure attachment which is maintained by conventional assembly fabrication such as . adhesives or sonic welding or the like. Sound unit housing 140 further defines an aperture 142 having a diameter essentially corresponding to that of center bore 121 of slide tube 120. Sound unit housing 140 further defines an interior cavity 143 having an inwardly extending lip 125 and a slightly tapered recess 124. A hard resilient diaphragm 146 having a generally planar disk-like shape is loosely received within recess 124 and is positioned near lip 125 of sound unit housing 140. A slightly tapered sound horn 103 extends into and is received within recess 124 of sound unit housing 140. Sound horn 103 and lip 125 loosely captivate the outer perimeter of diaphragm 146 within housing 140. Sound horn 103 is secured to housing 140 by conventional attachment means such as adhesive or sonic welding or the like and defines a resonance passage 147 extending outwardly from diaphragm 146.

A generally cup-shaped diaphragm cone 145 defines an open end proximate diaphragm 146 and a closed end facing toward aperture 142 of housing 140. A resilient foam ring 144 is received within interior cavity 143 of housing 140 and positions and resiliently secures comb 145 within interior cavity 143 tightly against diaphragm 146.

A generally cylindrical slide weight 130 is received within and movable with respect to center bore 121 of slide tube 120. Slide weight 130 includes a friction reducing outer sleeve 131 and a pair of end portions 132 and 133. A molded foam covering 105 is formed about sound horn 103, sound unit housing 140, and slide tube 120 in a conforming molded attachment. Fluted outer surface 123 of slide tube 120 functions in the attachment of foam covering 105 to prevent twisting of the foam covering which would otherwise occur in the absence of the fluted outer surface.

Figure 6:
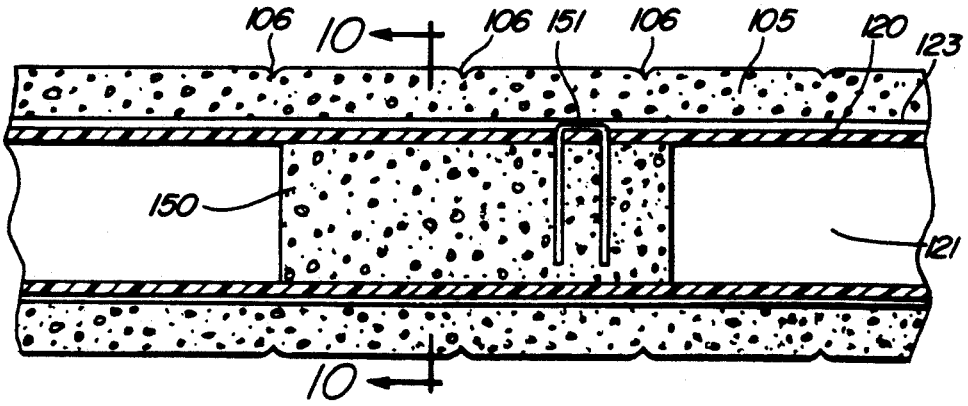
FIG. 6 sets forth a partial section view of a portion of the present invention improved sound producing game bat taken along section lines 6—6 in FIG. 4.
Figures 7, 8, 9, 10:
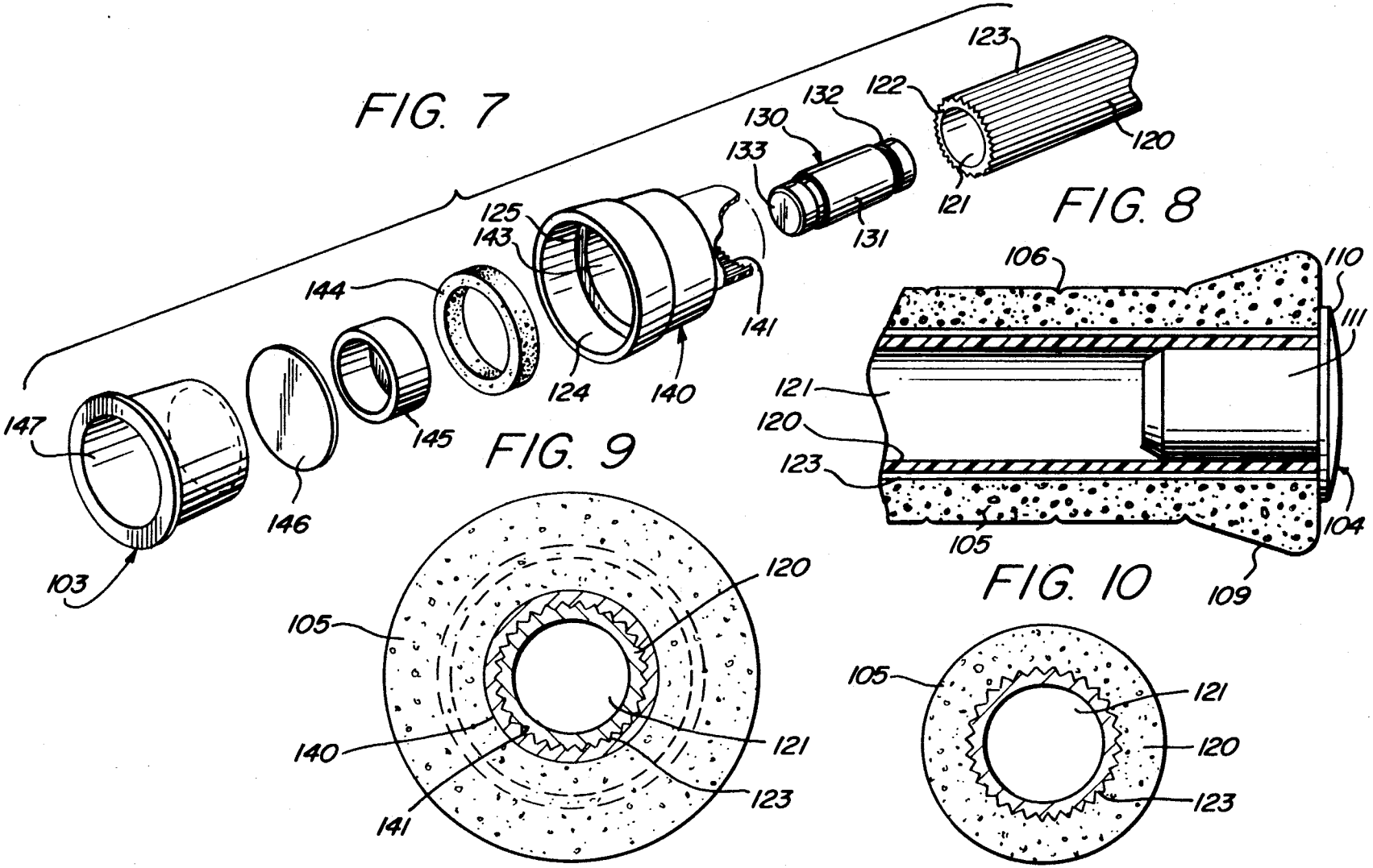
FIG. 7 is a perspective assembly view of a portion of the present invention improved sound producing game bat.
FIG. 8 sets forth a section view of a portion of the present invention game bat taken along section lines 8—8 in FIG. 4.
FIG. 9 sets forth a section view of the present invention improved sound producing game bat taken along section lines 9—9 in FIG. 5.
FIG. 10 sets forth a section view of a portion of the present invention improved sound producing game bat taken along section lines 10—10 in FIG. 6.

It should be apparent from simultaneous reference to FIGS. 5, 6 and 8 that slide tube 120 extends uninterrupted from sound unit housing 140 to end plug 104 and thus forms the main structural element of game bat 100. In accordance with the anticipated use of game bat 100, the centrifugal force produced upon slide weight 130 as the batter swings game bat 100 through the swing ark produces a centrifugal acceleration which acts upon slide weight 130 in the direction of arrow 150 causing slide weight 130 to move rapidly through center bore 121 and aperture 142 to impact diaphragm cone 145. Upon impact, the resilience of diaphragm 146 and foam ring 144 cooperate to transfer the energy of sliding weight 130 to vibrational energy within diaphragm 146 producing a sound output which travels outwardly from diaphragm 146 through resonance passage 147. In its preferred form, the resilience of foam ring 144, the material of diaphragm cone 145, and diaphragm 146 are selected together with the weight of slide weight 130 to provide a "crack of the bat" type sound during the batter's swing. While any number of materials may be used to fabricate slide tube 120, sound unit housing 140, diaphragm cone 145, diaphragm 146, and sound horn 103, it has been found advantageous to fabricate each from molded plastic somewhat resilient materials.

At the completion of the batter's swing, slide weight 130 will be generally at rest near end 122 of slide tube 120. Thereafter, the batter simply raises game bat 100 to a somewhat vertical orientation causing a gravitational force in the direction of arrow 151 to move slide weight 130 toward handle portion 101 (seen in FIG. 4) in preparation for the next swing of the bat.

FIG. 6 sets forth a section view of a portion of game bat 100 showing the energy absorbing travel limit means which act upon slide weight 130 when game bat 100 is raised to a generally vertical orientation. Specifically, FIG. 6 shows a portion of slide tube 120 defining a center bore 121 and a fluted outer surface 123. Foam covering 105 is molded upon slide tube 120 as described above and thus forms about fluted outer surface 123 to provide a secure nontwisting attachment between foam covering 105 and slide tube 120. A generally cylindrical resilient damper 150 is received within center bore 121 at the desired travel limit position for slide weight 130 and is secured therein by a generally U-shaped conventional staple 151 which is driven through slide tube 120 to secure damper 150. Thus as slide weight 130 travels toward handle 101 in the direction indicated by arrow 151 in FIG. 5, the extent of travel into handle portion 101 is limited by the position of damper 150. The resilience of damper 150 precludes the production of undesired noise at this end of the slide weight travel.

FIG. 7 sets forth an assembly view of the sound unit portion of the present invention game bat. As described above, slide tube 120 forms a generally cylindrical member having a center bore 121, an end 122 and a fluted outer surface 123. A slide weight 130 defines a generally cylindrical configuration and supports a friction reducing sleeve 131 and defines end portions 132 and 133. Slide weight 130 is received within center bore 121 of slide tube 120. A sound unit housing 140 defines a fluted bore 141 which receives end 122 and a portion of fluted outer surface 123 in a secure engagement. Sound unit housing 140 further defines a interior recess 124 and an interior cavity 143 separated by an inwardly extending lip 125. An annular foam ring 144 is received within interior cavity 143 and a generally cup-shaped cylindrical diaphragm cone 145 is received within interior cavity 143 and resiliently secured therein by foam ring 144. Diaphragm 146 is received against diaphragm cone 145 and rests upon lip 125 within housing 140. Sound horn 103 defines an interior resonance passage 147 and is received within recess 124 in a secure attachment such that diaphragm 146 is captivated by sound horn 103 against lip 125.

FIG. 8 sets forth a section view of the end portion of game bat 100 taken along section lines 8—8 in FIG. 4. Slide tube 120 defines a center bore 121 and a fluted outer surface 123. A foam cover 105 defines a plurality of serrations 106 and an expanded knob 109 and is formed upon fluted outer surface 123 of slide tube 120. An end plug 104 includes a generally domed cap 110 and a cylindrical insert 111. The latter is received within center bore 121 of slide tube 120 and secured therein by conventional attachment means such as adhesives, sonic welding or the like.

FIG. 9 sets forth a section view of game bat 100 taken along section lines 9—9 in FIG. 5. Slide tube 100 defines a center bore 121 and a fluted outer surface 123. Sound unit housing 140 defines an internally fluted bore 140 which receives fluted outer surface 123 of slide tube 120 to provide a secure attachment therebetween. Foam cover 105 is molded upon slide tube 120 and sound unit housing 140 in the manner described above.

FIG. 10 sets forth a section view of game bat 100 taken along section lines 10—10 in FIG. 6. Game bat 100 includes a cylindrical slide tube 120 having an externally fluted outer surface 123 and a center bore 121 therein. A resilient foam cover 105 is molded upon slide tube 120 and securely attaches to fluted outer surface 123 to prevent twisting between foam cover 105 and slide tube 120.

The embodiment shown in FIGS. 4 through 10 provides substantial advantage over prior art sound producing game bats in that a resilient foam outer cover may be advantageously used while retaining the substantial sound producing qualities of the sounding unit. In particular, the combination of sound horn 103, diaphragm 146, cone 145 and the resilient support provided therefor by foam ring 144 permit significant sound production which is not interfered with the presence of foam outer covering 105.

What has been shown is a novel sound producing game bat having a substantially improved sound producing mechanism together with the advantageous foam outer covering often desired in such game bats. The system utilized is relatively inexpensive to fabricate and provides a simple but effective assembly which reliably captivates the sliding weight within the slide tube for enhanced safety of operation.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A game bat comprising:

an elongated slide tube defining first and second ends and a passage therethrough;

a slide weight slidably supported within said passage;

a sound housing having an interior cavity coupled to said first end of said slide tube;

a diaphragm supported within said sound housing; and a diaphragm cone;

means for resiliently supporting said cone within said interior cavity proximate said diaphragm, said slide weight sliding through said passage during a batter swing to impact said diaphragm cone causing diaphragm vibration and sound.

2. A game bat as set forth in claim 1 wherein said slide tube is generally cylindrical and wherein said passage defines a center bore therein.

3. A game bat as set forth in claim 2 further including travel limit means within said center bore proximate said second end of said slide tube for limiting slide weight travel toward said second end.

4. A game bat as set forth in claim 3 wherein said diaphragm cone forms a generally cylindrical cup-shaped member having an open end contacting said diaphragm and a closed end facing said first end of said slide tube.

5. A game bat as set forth in claim 4 wherein said means for resiliently supporting said cone include an annular ring formed of a resilient material and encircling said cone.

6. A game bat as set forth in claim 5 wherein said travel limit means include a resilient cylinder received within said center bore at the point of desired travel limit.

* * * * *